United States Patent [19]

Neveux

[11] 4,083,332

[45] Apr. 11, 1978

[54] FITTING OF A FLUID TEMPERATURE SWITCH IN A WALL

[75] Inventor: René Elie Neveux, les Clayes-sous-Bois, France

[73] Assignee: Societe Anonyme Francaise de Ferodo, Paris, France

[21] Appl. No.: 699,675

[22] Filed: Jun. 25, 1976

[30] Foreign Application Priority Data

Jun. 30, 1975 France ..... 75 20475

[51] Int. Cl.[2] ..... F02M 13/06

[52] U.S. Cl. ..... 123/41.15; 165/11; 277/205; 123/41.12; 200/83 R; 200/302

[58] Field of Search ..... 200/83 R, 83 P, 83 B, 200/83 F, 83 V, 83 D, 302, 295, 294, 296, 81 R; 123/41.02, 41.05, 41.12, 41.15

[56] References Cited

U.S. PATENT DOCUMENTS

| | | | |
|---|---|---|---|
| 3,376,794 | 4/1968 | Griffith et al. | 200/83 B |
| 3,553,402 | 1/1971 | Hire | 200/83 P |
| 3,673,369 | 6/1972 | Weaver | 200/83 V |
| 3,793,495 | 2/1974 | Heap | 200/83 B |
| 3,904,842 | 9/1975 | Gaver | 200/81 R |

*Primary Examiner*—Charles J. Myhre
*Assistant Examiner*—R. A. Nelli
*Attorney, Agent, or Firm*—Wigman & Cohen

[57] ABSTRACT

Fitting of a fluid temperature switch unit of the kind including an enclosure having an end face at one end and a bimetal disc at the other end, in a chamber containing a fluid and having a wall comprising a recess having a bottom-face formed with an opening leading into the chamber. The bottom-face is covered by a metal plate, and the opening is sealed by urging the metal plate toward the recess wall, while the end of the unit containing the bimetal disc is pressed against the metal plate.

14 Claims, 10 Drawing Figures

FITTING OF A FLUID TEMPERATURE SWITCH IN A WALL

BACKGROUND OF THE INVENTION

This invention relates to fluid temperature switches, and more particularly to the fitting of such a switch into the wall of a chamber containing a fluid and most notably into the wall of an automobile radiator header tank.

A fluid temperature switch unit takes the form of a generally cylindrical insulating enclosure, one end of which contains a bimetal disc which deforms under heat whereby to make or break contact between two electrical conductors connected to terminal tags projecting from the enclosure. Such switches are made wide use of in the header tanks of engine cooling radiators on automobiles, for instance for stopping or starting — depending on the water temperature — a fan for accelerating the airflow through the radiator.

The walls of header tanks are ordinarily made of metal and, in order to mount a water temperature switch thereon, the latter is set into a threaded brass plug which is screwed into a hole tapped in the wall in such manner that the metal of the plug bear leaktightly against the metal of the wall. It is necessary for such plug to possess a high calorific capacity so that it should not assume (nor transmit to the bimetal disc of the switch) the mean temperature prevailing in the metal wall of the header tank as a result of the heat transfer taking place between the wall and the exterior. Because of its high calorific capacity, the plug will follow the temperature fluctuations of the water inside the header tank with a certain time-lag, but nevertheless more faithfully than if it had low calorific capacity. The threaded plug must therefore have a large mass of brass and is relatively very costly, and in fact the direct cost of a switch set into such a threaded plug is about twice as much as that of the switch alone.

Use is also made of header tanks having walls made of synthetic resin. In order to mount a water temperature switch into such walls, the current technique is to screw the threaded brass plug containing the switch into a tapped brass sleeve which engages into a recess in the wall. However, it is almost impossible to obtain satisfactory sealing between the brass sleeve and the recess in synthetic resin. The plug must therefore be sealingly applied against a portion of the synthetic resin recess that projects beyond the brass sleeve, thereby complicating the fitting operation.

OBJECTS AND SUMMARY OF THE INVENTION

It is an object of this invention to dispense with the need to set a fluid temperature switch into a metal plug of high calorific capacity.

Another object of the invention is to enable a fluid temperature switch to be fixed directly into the wall of a chamber containing a fluid.

It is yet another object of the invention to enable a fluid temperature switch to be fixed into the insulating wall of a fluid-containing chamber, most notably into a synthetic resin wall, through the agency of means ensuring both leaktightness of the mounting and heat transmission from the fluid to the bimetal disc of the switch.

In accordance with this invention, the switch unit is placed in a recess formed in the chamber wall and having a bottom-face with an opening therein communicating with said chamber, said bottom-face being covered by a metal plate and means being provided to seal the opening by pressure contact of said plate, with a possibly interposed seal, against the bottom or the adjacent wall of the recess, and to apply the end of said bimetal-disc-containing switch unit against said plate.

In one embodiment, the recess is tapped and the switch unit engages into a threaded bush which screws into the recess and the end of which urges the plate periphery towards the bottom-face of the recess, the bush being formed internally with a flexible lip or like means that bear against the end of the switch in order to maintain its end against said plate.

In an alternative embodiment, the plate is formed along its periphery with radially projecting tongues which are buttressed against the recess walls so as to urge the plate against the bottom-face of the recess and thereby compress a flexible seal between said bottom-face and said plate. In still another form of embodiment, the plate is provided with a peripheral flange which is crimped against the recess wall adjacent the periphery of the recess bottom-face, sealing being ensured by the crimp. In the last two of these forms of embodiment, the switch unit can be made fast inside the recess by means of flexible tabs having inclined internal surfaces bearing against the end of the unit.

BRIEF DESCRIPTION OF THE DRAWING

The description which follow with reference to the accompanying non-limitative exemplary drawings will give a clear understanding of how the invention can be carried into practice.

In the drawings.

DETAILED DESCRIPTION OF PREFERRED EMBODIMENTS

Figure 1:
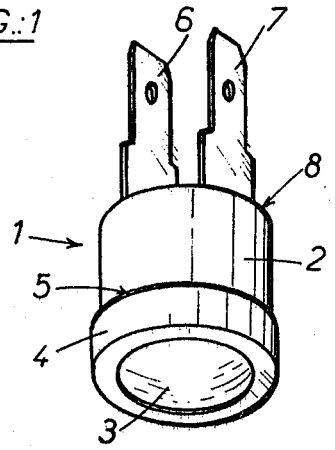
FIG. 1 is a perspective view of a water temperature switch unit.

The switch unit shown in FIG. 1 is generally designated by reference numeral 1 and includes a cylindrical enclosure 2 made of insulating material, the lower open end of which is closed by a bimetal disc 3 which is restrained by a ring 4 crimped to the cylinder wall at 5. Bimetal disc 3 is dished outwardly at normal temperatures. When its temperature exceeds a specific value, it suddenly changes its position of equilibrium and becomes inwardly dished, thereby making or breaking contact between two electrical conductors (not shown) connected respectively to two terminals 6, 7 issuing through the upper end 8 of the enclosure. This switch unit is of a type well-known per se and need not be described in greater detail. It is designed to be fixed into the wall of the header tank of an automobile radiator (not shown) for the purpose of starting and stopping a fan (likewise not shown and having its electric circuit connected to terminals 6, 7) according as the water temperature is greater or less than a specified temperature.

Figure 2:
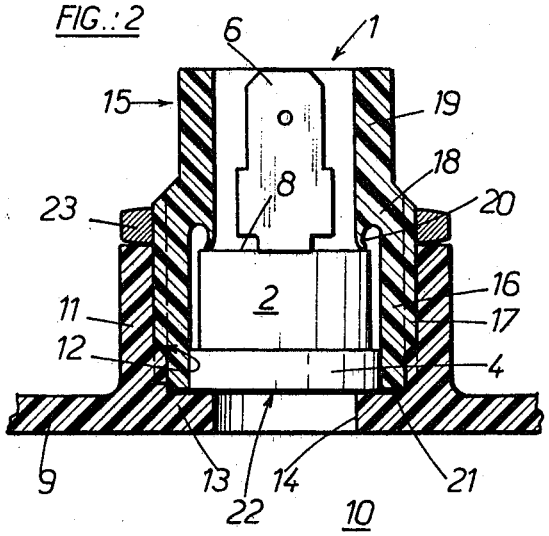
FIG. 2 illustrates a possible method of fitting said switch unit, shown in side elevation, into a header tank wall made of synthetic resin, the assembly being shown in cross-section.

In FIG. 2 reference numeral 9 designates a header tank wall made of synthetic resin such as a polyamide, the interior of the header tank being at 10. The wall 9 is formed with a cylindrical boss 11 projecting from the header tank and having on its inner face a screw-thread 12 molded on together with the boss and the rest of wall 9. Wall 9 extends into boss 11 to form a bottom-face 13 thereon which is itself formed with a central opening 14. Switch 1 is mounted inside the recess formed by the tapped internal cavity of boss 11, through the agency of a bush 15 made of a synthetic resin such as polytetrafluoroethylene or polyoxymethylene. Bush 15 is formed with a lower cylindrical portion 16 carrying an external screw-thread 17 and joined via a shoulder 18 to a narrower upper portion 19 the outer surface of which forms a hexagon and the inner cylindrical surface of which is extended downwardly by an annular lip 20 projecting into lower portion 16.

The dimensions of bush 15 are such that the internal recess of portion 16 can receive switch 1 and that, when the end 8 thereof is in contact with lip 20, the crimping ring 4 projects a few millimeters beyond the edge 21 of the wall of portion 16.

In order to fit switch 1 into wall 9, the switch is engaged upwardly into bush 15, after which a metal disc 22 is placed on bottom-face 13 and the screw-thread 17 of bush 15 is screwed into the screw-thread 12 tapped inside the recess. When the bush has been screwed home, lip 20 bears against the switch end 8 resting on metal disc 22. When screw-thread 17 is tightened hard into screw-thread 12 by means of a spanner engaged over the hexagonal part of portion 19, the end 21 of the bush wall is tightened against the peripheral portion of metal disc 22 sufficiently to apply said peripheral portion leaktightly against the synthetic resin bottom-face 13. Lip 20 is flexible enough to flex during this tightening operation; it serves to keep the crimping ring 4 applied against disc 22 while at the same time limiting the force exerted on enclosure 2. Having completed the fitting operation, the bush is locked with a locknut 23 screwed over screw-thread 17.

By virtue of this arrangement, bimetal disc 3 is in contact, through the medium of its crimping ring 4, with metal disc 22 which is itself in contact with the water contained in the header tank at 10 and consequently follows the variations in temperature therein with a negligible time-lag. Heat transmission and leaktightness are consequently ensured without the need to set the switch unit into a metal plug.

Figure 3:
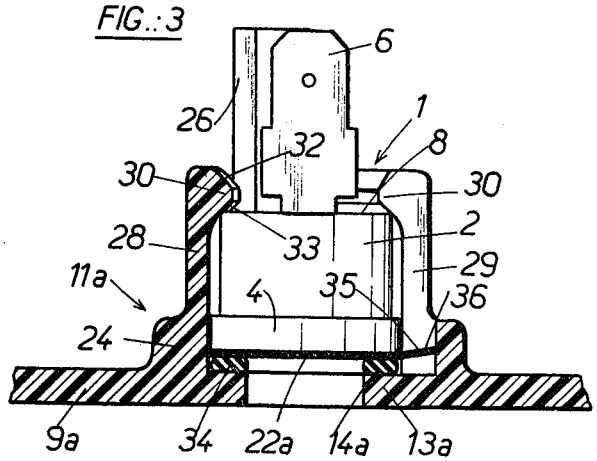
FIG. 3 is a view corresponding to FIG. 2, showing an alternative embodiment in which the assembly is shown in section through the line III—III of FIG. 4.
Figure 4:
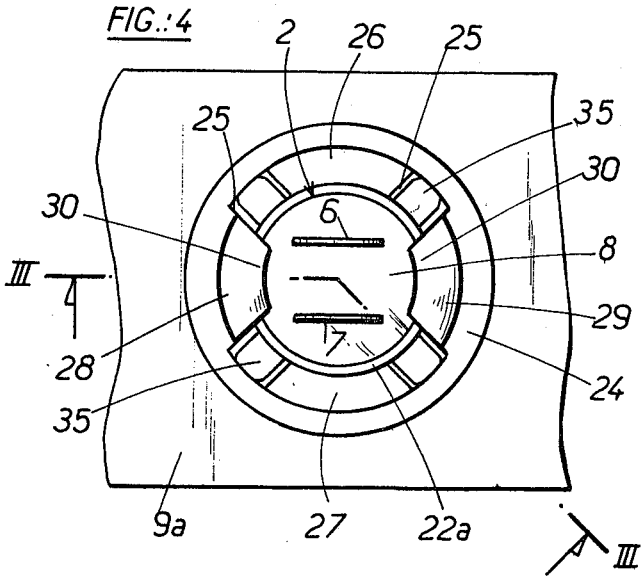
FIG. 4 is a top view of the arrangement in FIG. 3.
Figure 5:
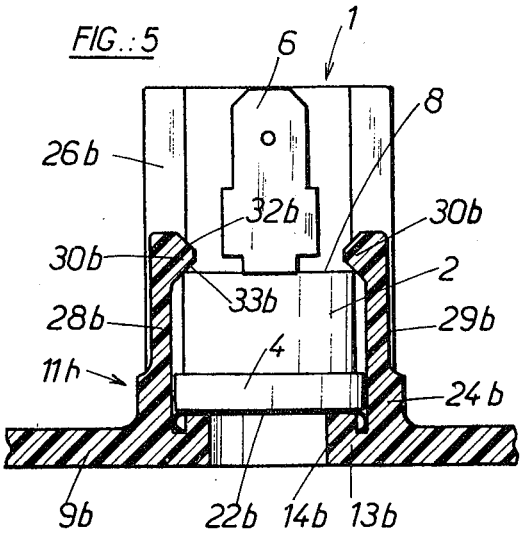
FIG. 5 is a view corresponding to FIGS. 2 and 3, showing still another embodiment, the assembly being shown in section through the line V—V of FIG. 6.
Figure 6:
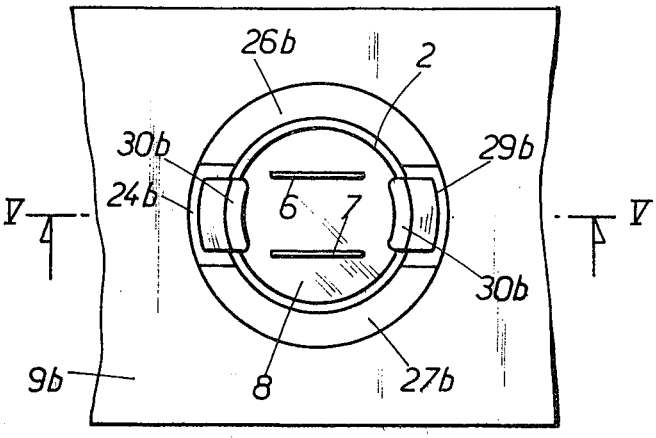
FIG. 6 is a top view of the arrangement in FIG. 5.

In the form of embodiment shown in FIGS. 3 and 4, in which like parts to those in the embodiment shown in FIG. 2 are designated by like reference numerals followed by the subscript *a*, the wall of the boss 11*a* forming the recess for switch 1 comprises a short cylindrical base 24 formed with four equi-angularly spaced notches and surmounted, between these notches, on the one hand by two diametrically opposed arcuate walls 26, 27 of substantially the same height as switch 1 and, on the other, by two shorter fastening tabs 28, 29 each formed, near its apex, with a nose 30 turned into the lodging and having two upper and lower surfaces 32, 33 sloping at 45° in opposite directions.

An annular seal 34 made of elastomer material is positioned on bottom-face 13*a* around the opening 14*a*, and above the seal is placed a disc-shaped metal plate 22*a* formed at its periphery with four radially projecting and equiangularly spaced tongues 35. The tongues 35 are slightly narrower than the notches 25 and the outer ends of two diametrically opposed tongues are slightly more spaced than the surfaces 36 forming the bottoms of two diametrically opposed notches 25. By using a mandrel (not shown) to press the plate 22*a* against the recess bottom-face 13*a*, the tongues 35 are constrained to bend upwards slightly and to abut against the surfaces 36 and thereby keep the seal 34 compressed between the plate and the bottom-face, thus sealing the opening 14*a*. The switch 1 is then placed in position by pressing the crimping ring 4 against the upper surfaces 32 of the noses 30 of fastening tabs 28, 29, thereby to cause the latter to flex outwardly and let the enclosure 2 through. When the end of the enclosure lies opposite the lower surfaces 33, the fastening tabs close back inwardly. The tabs are dimensioned so as to then maintain the crimping ring 4 in contact with plate 22*a*. The walls 26, 27 serve to protect the terminals 6, 7.

The embodiment depicted in FIGS. 3 and 4 offers the same advantages, indicated precedingly, as the embodiment in FIG. 2 and additionally allows of removing switch unit 1 without draining the header tank since sealing continues to be ensured by the plate 22*a*. To remove switch 1, it will suffice to draw it out of its lodging in such manner that the force exerted on the lower surfaces 33 of the noses 30 of fastening tabs 28, 29 cause the latter to flex outwardly in order to give way to enclosure 2.

Figure 7:
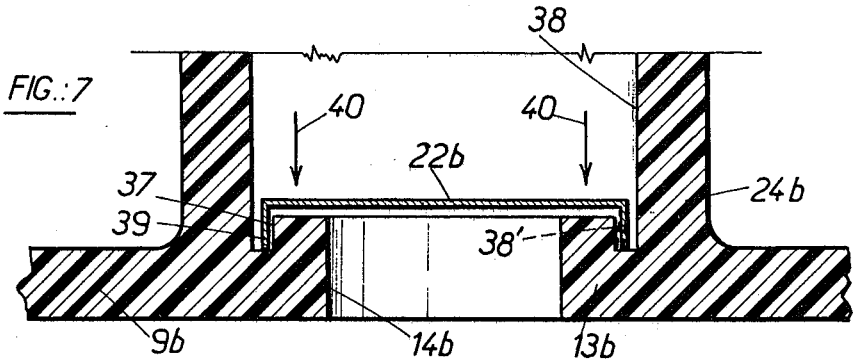
FIGS. 7 and 7*a* are fragmental views similar to FIG. 5 but on an enlarged scale, illustrating the arrangement used for the plate.

The embodiment shown in FIGS. 5, 6, 7 and 7*a*, on which like parts to those in FIGS. 3 and 4 are designated by like reference numerals followed by the subscript *b*, differs from the previously described embodiment in respect of means for fixing the plate leaktightly to the bottom-face of the recess. Recess 11*b* is devoid of notches such as the notch 25 in FIGS. 3 and 4, and the circumferential development of walls 26*b*, 27*b* is accordingly increased and the thickness of cylindrical base 24*b* reduced. Bottom-face 13*b* is thicker than the rest of header tank wall 9*b* and is formed at its periphery with an annular groove 37 the outer surface of which extends downwardly the inner surface 38 of base wall 24*b* (FIG. 7).

Figure 7A:
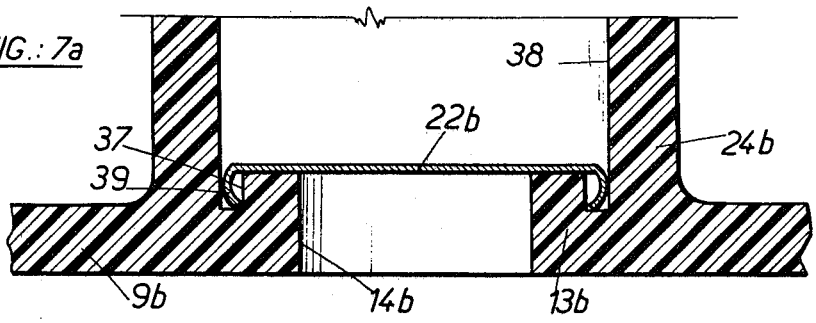

Plate 22*b* is cup-shaped and formed at its periphery with a cylindrical flange 39 the height of which greatly exceeds the depth of groove 37. Plate 22*b* is secured by placing it on bottom-face 13*b* in the position shown in FIG. 7, that is to say so that flange 39 rests on the bottom of groove 37, after which a mandrel (not shown) is used to exert force in the direction of arrows 40 on the periphery of cup 22*b* so that the flange 39 is set into the groove 37 by leaktight pressure contact against surface 38 (FIG. 7*a*). This crimping can be facilitated by imparting to the flange 39, prior to crimping, a slightly frustoconical shape as shown in dash lines at 38' in FIG. 7. The switch 1 is fitted in exactly the same way as described with reference to FIGS. 3 and 4.

Figure 8:
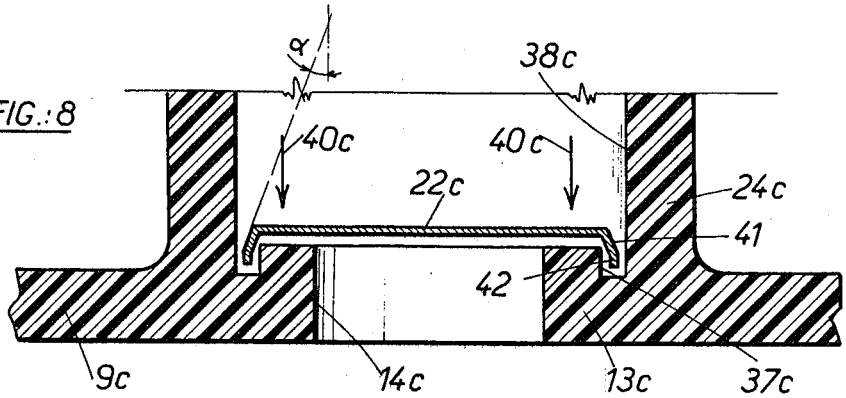
FIGS. 8 and 8*a* are views corresponding to FIGS. 7 and 7*a*, illustrating an alternative embodiment.
Figure 8A:
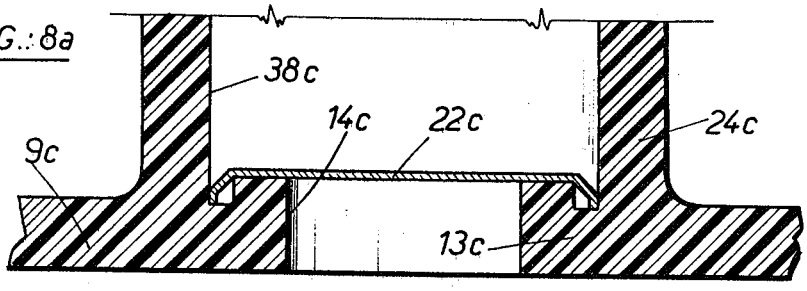

In the alternative embodiment of FIGS. 8 and 8*a*, plate 22*c* is formed at its periphery with a frustoconical portion 41 the central portion of which slopes only slightly (cone apex half-angle $\alpha$ about 15° to 20°), followed by a short cylindrical flange 42. The effect of the crimping force 40*c* is to straighten the peripheral portions somewhat and hence to apply flange 42 sealingly against surface 38*c* (FIG. 8*a*).

It will be apparent that many changes and substitutions of parts may be made in the exemplary embodiments hereinbefore described without departing from the scope of the invention as defined in the appended claims. Specifically, the peripheral portion of the cup in FIG. 8 could have a shape other than frusto-conical, such as a downwardly curving shape. Nor would it be to depart from the scope of the invention to interpose a seal between the plate and the recess bottom-face in the embodiment shown in FIG. 2 or in those shown in FIGS. 5 through 8*a*.

Indeed it is to be understood that the present invention is by no means limited to the fitting of a water temperature switch unit into a wall made of synthetic resin or other insulating material. In the event that such wall is made of metal, contact of plate 22 or 22*b* or 22*c* with the metal wall, which takes place over areas of limited extent, will cause only small heat transfers and will consequently not prevent bimetal disc 3 from following variations in the temperature quite faithfully. The bimetal disc will follow such temperature variations even more faithfully if a seal is interposed between the plate and the recess bottom-face.

I claim:

1. In an assembly of a fluid temperature switch unit of the kind including an enclosure having an end-face at one end and a bimetal disc at the other end, with a chamber containing a fluid and having a wall comprising a recess having a bottom-face formed with an opening therein communicating with said chamber, the improvement which includes a metal plate covering said bottom-face, and means for sealing said opening by urging said plate toward the wall recess and for applying the end of said switch unit containing the bimetal disc against said plate.

2. An assembly as claimed in claim 1, including a seal between the plate and the wall recess.

3. An assembly as claimed in claim 1, including a screw-thread tapped in the recess and a threaded bush adapted to screw into said screw-thread in such manner that the end of the bush urge the periphery of the plate against said bottom-face, said bush having an internal flexible lip adapted to thrust against the end-face of said switch unit whereby to restrain the end of said switch unit against said plate.

4. An assembly as claimed in claim 2, in which the plate is formed at its periphery with radially projecting tongues which are buttressed against the recess walls whereby to apply the plate against said bottom-face and thereby compress the seal between said bottom-face and said plate.

5. An assembly as claimed in claim 1, in which the plate is formed with a peripheral flange which is crimped against the recess wall adjacent the periphery of said bottom-face, leaktightness being ensured by the crimping.

6. An assembly as claimed in claim 4, in which the crimping is effected by deformation of the flange inside a circular groove formed along the periphery of said bottom-face.

7. An assembly as claimed in claim 5, in which the flange is slightly frusto-conically shaped prior to crimping.

8. An assembly as claimed in claim 4, in which the crimping is effected by straightening a peripheral portion of the plate which, prior to crimping, is of frusto-conical or curved shape.

9. An assembly as claimed in claim 4, in which said unit is secured in the recess by fastening means formed by flexible arms fast with said recess and formed internally with sloping surfaces which bear against the end-face of said unit.

10. An assembly as claimed in claim 1, in which the chamber is the header tank of an automobile radiator.

11. An automobile radiator, comprising a header tank having a wall which includes a recess having a bottom-face formed with an opening debouching into the header tank; a water temperature switch unit engaging into said recess, said unit being of the kind comprising an enclosure having an end-face at one end and a bimetal disk at the other end; a metal plate for covering said bottom-face; and means for sealing said opening by urging said plate toward the recess wall and for applying the end of said unit containing the bimetal disk against said plate.

12. An assembly as claimed in claim 1 wherein said chamber recess is formed within an outwardly projecting boss, the internal periphery of said boss being formed with threads for threadingly receiving an externally threaded bush, said recess including an opening communicating with said chamber interior, said opening having a cross-sectional area smaller than the cross-sectional area of said recess, said metal plate covering said opening in said recess and in sealing contact with said bush and said opening.

13. An assembly as claimed in claim 12 wherein said bush includes locking means mounted on said bush for maintaining said bush in secured relationship with respect to said boss.

14. An assembly as claimed in claim 12 wherein said chamber wall is part of a header tank of an automobile radiator.

* * * * *